US010328570B1

(12) United States Patent
O'Donnell

(10) Patent No.: US 10,328,570 B1
(45) Date of Patent: Jun. 25, 2019

(54) CREEPER

(71) Applicant: SHINN FU COMPANY OF AMERICA, INC., Kansas City, MO (US)

(72) Inventor: Colin O'Donnell, Roeland Park, KS (US)

(73) Assignee: SHINN FU COMPANY OF AMERICA, INC., Kansas City, MO (US)

( * ) Notice: Subject to any disclaimer, the term of this patent is extended or adjusted under 35 U.S.C. 154(b) by 0 days.

(21) Appl. No.: 15/956,527

(22) Filed: Apr. 18, 2018

(51) Int. Cl.
*B25H 5/00* (2006.01)

(52) U.S. Cl.
CPC ..... *B25H 5/00* (2013.01)

(58) Field of Classification Search
CPC ..... B25H 5/00
USPC ..... 280/32.6
See application file for complete search history.

(56) References Cited

U.S. PATENT DOCUMENTS 895,380 A 8/1908 Lombard
5,472,219 A * 12/1995 Eckstrum ..... B25H 5/00 188/5
5,611,552 A * 3/1997 Miles ..... B25H 5/00 280/32.5
5,707,067 A * 1/1998 Smith ..... B25H 5/00 280/32.6
5,730,449 A * 3/1998 Miles ..... B25H 5/00 280/32.5
5,895,062 A * 4/1999 Miles ..... B25H 5/00 280/32.6
5,947,489 A * 9/1999 Tucker ..... B25H 5/00 280/32.6
6,076,838 A * 6/2000 Peterson ..... B25H 5/00 188/5
6,095,532 A * 8/2000 Martin ..... B25H 5/00 280/30
6,199,877 B1 * 3/2001 Shockley ..... B25H 5/00 280/32.6
6,345,828 B1 * 2/2002 Pool ..... B25H 5/00 280/32.6
6,425,590 B1 * 7/2002 Whiteside ..... B25H 5/00 280/32.5
6,578,857 B1 * 6/2003 Whiteside ..... B25H 5/00 280/32.5
6,607,207 B2 * 8/2003 Shapiro ..... B62K 9/00 280/261

(Continued)

*Primary Examiner* — Jeffrey J Restifo
(74) *Attorney, Agent, or Firm* — Lathrop Gage L.L.P.

(57) ABSTRACT

A creeper has a frame with a first end and a second end; a body cushion mounted at the first end; a head cushion mounted at the second end, and hingedly connected to the frame; and a plurality of wheel assemblies rotatably mounted to the frame. Each wheel assembly includes a wheel with an attachment member; a bracket having a first opening and a second opening; and first and second fasteners. The first opening in the bracket corresponds to a first opening in the frame, and the first fastener passes through the respective first openings. The second opening in the bracket corresponds to one of a second opening and a third opening in the frame, and the second fastener passes through the second opening of the bracket and one of the second or third openings to rotate the bracket between an operation and a storage position, respectively.

21 Claims, 12 Drawing Sheets

(56) References Cited

U.S. PATENT DOCUMENTS 6,702,305 B2 * 3/2004 Miles ..... B25H 5/00 280/32.5
6,705,622 B2 * 3/2004 Whiteside ..... B25H 5/00 16/20
6,733,026 B1 * 5/2004 Robberson ..... B62B 3/02 280/30
6,871,861 B2 * 3/2005 Hernandez, Jr. ..... B25H 5/00 248/129
6,969,077 B2 * 11/2005 Liu ..... B25H 5/00 280/30
7,032,908 B2 * 4/2006 Melvin ..... B25H 5/00 280/32.6
7,032,909 B2 * 4/2006 Lensing ..... B25H 5/00 280/32.6
7,213,815 B2 * 5/2007 Whiteside ..... B25H 5/00 16/45
7,360,783 B2 * 4/2008 Home ..... A47J 37/0704 211/195
7,374,181 B1 * 5/2008 Wu ..... B25H 5/00 280/32.5
7,434,817 B2 * 10/2008 Rush ..... B25H 5/00 280/32.5
7,478,818 B1 * 1/2009 Whiteside ..... B25H 5/00 280/32.5
7,481,438 B2 * 1/2009 Hernandez ..... B25H 5/00 280/32.5
7,726,668 B2 * 6/2010 Sieb ..... B25H 5/00 280/32.6
8,152,179 B2 * 4/2012 Yang ..... A61G 5/08 280/38
8,632,231 B1 * 1/2014 McCullough ..... B25H 5/00 280/32.6
9,061,413 B2 * 6/2015 Huang ..... B60Q 1/24
9,241,849 B1 * 1/2016 Caskey ..... A61G 1/02
9,333,823 B2 * 5/2016 Shahroodi ..... B60D 1/665
9,339,928 B1 * 5/2016 Obitts ..... B25H 5/00
10,029,362 B2 * 7/2018 Fuentes ..... B25H 5/00
2005/0023780 A1 * 2/2005 Liu ..... B25H 5/00 280/32.6
2007/0013154 A1 * 1/2007 Staples ..... B25H 5/00 280/32.6
2009/0236577 A1 * 9/2009 Pollock ..... B60S 9/18 254/418
2011/0227303 A1 * 9/2011 Gering ..... B25H 1/04 280/32.6

* cited by examiner

CREEPER

FIELD OF THE INVENTION

The invention relates to a creeper. More specifically, the invention is directed to a creeper having rotatable wheels and/or an adjustable headrest.

BACKGROUND

Creepers are often used to perform maintenance on vehicles. Occasionally, the maintenance must occur in a less-than-ideal location, such as the side of the road. Traditional creepers usually have small, metal wheels that are designed for use in a garage or hard surface, but do not easily roll over the rough terrain encountered outside of the garage. Increasing the size of the tires and/or the material of the tires may help to eliminate some of these problems. However, this also increases the footprint of the creeper, which can be problematic due to space constraints on a vehicle.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a creeper has a frame with a first end and a second end spatially separated by first and second parallel members to form a generally rectangular configuration; a body cushion mounted at the first end of the frame; a head cushion mounted at the second end of the frame, the head cushion being hingedly connected to the frame; and a plurality of wheel assemblies rotatably mounted to the frame. Each wheel assembly includes a wheel with an attachment member; a bracket having a first opening and a second opening; and first and second fasteners. The first opening in the bracket corresponds to a first opening in the frame, and the first fastener is inserted through the respective first openings in the bracket and the frame to secure the bracket to the frame. The second opening in the bracket corresponds to one of a second opening and a third opening in the frame, and the second fastener is inserted through the second opening of the bracket and one of the second or third openings in the frame. When the second fastener is inserted through the second opening in the frame, the wheel assembly is in an operating position; and when the second fastener is inserted through the third opening in the frame, the wheel assembly is in a storage position.

In another embodiment, a creeper includes a frame having a first end and a second end to form a generally rectangular configuration; a body cushion mounted at the first end of the frame; a head cushion mounted at the second end of the frame and hingedly connected to the frame, and comprising a locking assembly attached to an underside thereof. The locking assembly has a latch rod with a middle portion and first and second end portions; first and second latch rod brackets secured to a bottom side of the head cushion, the first and second end portions being rotatably received into the respective first and second latch rod brackets; and a locking mechanism secured to an inner face of each of the parallel members, the middle portion of the latch rod being received into the respective locking mechanisms to secure the head cushion in an angled position. A plurality of wheel assemblies is rotatably mounted to the frame. Each wheel assembly includes a wheel with an attachment member; a bracket having a first opening and a second opening; and first and second fasteners. The first opening in the bracket corresponds to a first opening in the frame, and the first fastener is inserted through the respective first openings in the bracket and the frame to secure the bracket to the frame. The second opening in the bracket corresponds to one of a second opening and a third opening in the frame. The second fastener is inserted through the second opening of the bracket and one of the second or third openings in the frame. When the second fastener is inserted through the second opening in the frame, the wheel assembly is in an operating position; and when the second fastener is inserted through the third opening in the frame, the wheel assembly is in a storage position.

In still another embodiment, a creeper has a frame having a first end and a second end; a body cushion mounted at the first end of the frame; and a head cushion mounted at the second end of the frame, the head cushion being hingedly connected to the frame, and comprising a locking assembly attached to an underside thereof. The locking assembly has a latch rod; at least one latch rod bracket secured to a bottom side of the head cushion, a portion of the latch rod being rotatably received into the latch rod bracket; and a locking mechanism secured to an inner face of the frame, a portion of the latch rod being selectively received into the locking mechanism to secure the head cushion in an angled position. A plurality of rotatable wheel assemblies is rotatably mounted to the frame, each wheel assembly being configured to rotate between an operating position and a storage position, wherein, in the storage position, a bracket of the wheel assembly is horizontal relative to a ground surface.

In still yet another embodiment, a creeper includes a frame with a first end and a second end, a body cushion mounted at the first end of the frame, and a head cushion mounted at the second end of the frame; and a plurality of wheel assemblies rotatably mounted to the frame. Each wheel assembly has a wheel with an attachment member; a bracket having a first opening and a second opening; and first and second fasteners. The first opening in the bracket corresponds to a first opening in the frame, and the first fastener is inserted through the respective first openings in the bracket and the frame to secure the bracket to the frame. The second opening in the bracket corresponds to one of a second opening and a third opening in the frame. The second fastener is inserted through the second opening of the bracket and one of the second or third openings in the frame. When the second fastener is inserted through the second opening in the frame, the wheel assembly is in an operating position; and when the second fastener is inserted through the third opening in the frame, the wheel assembly is in a storage position.

DETAILED DESCRIPTION

Figure 1:
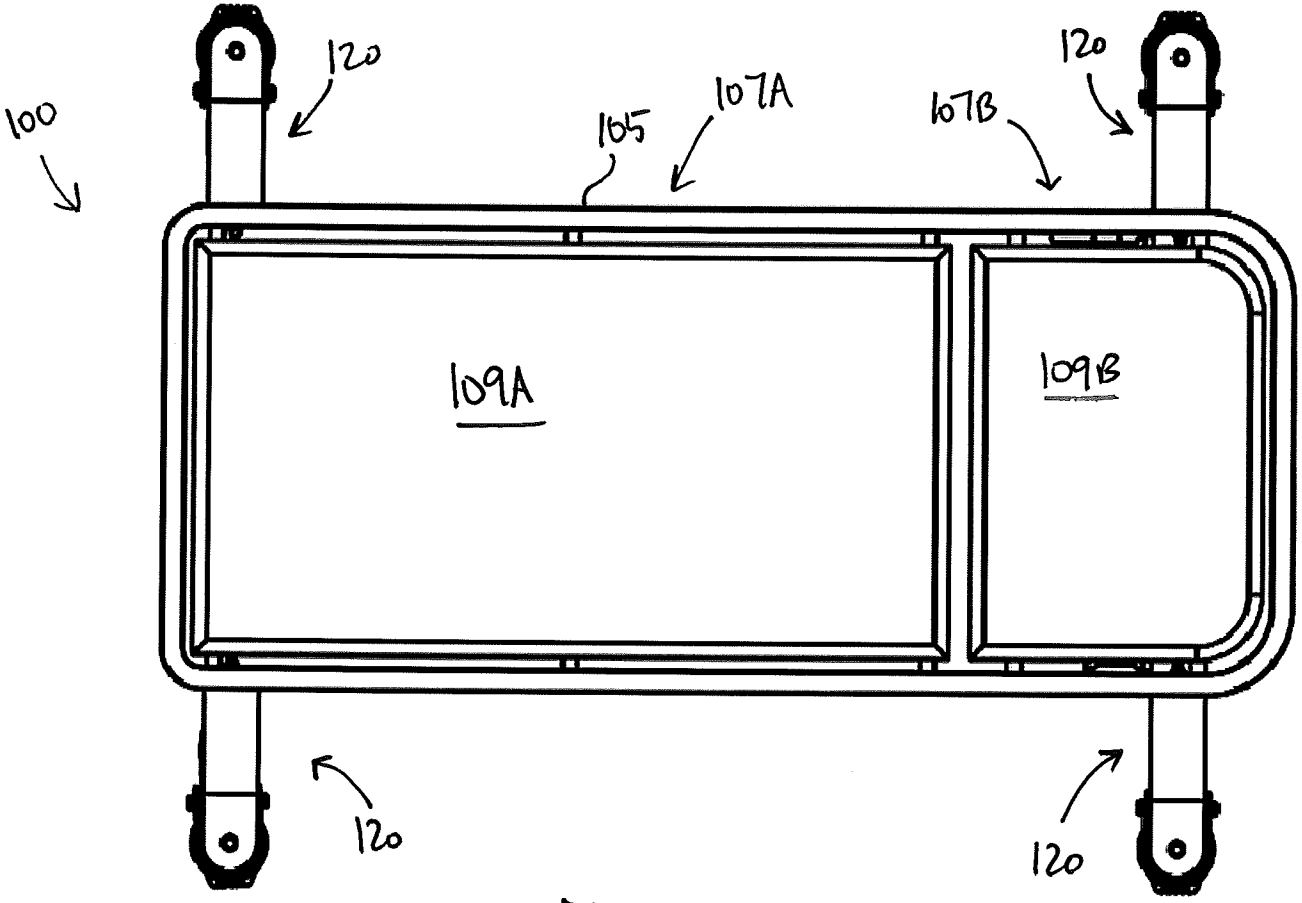
FIG. 1 is a top view of a creeper according to an embodiment of the invention.
Figure 2:
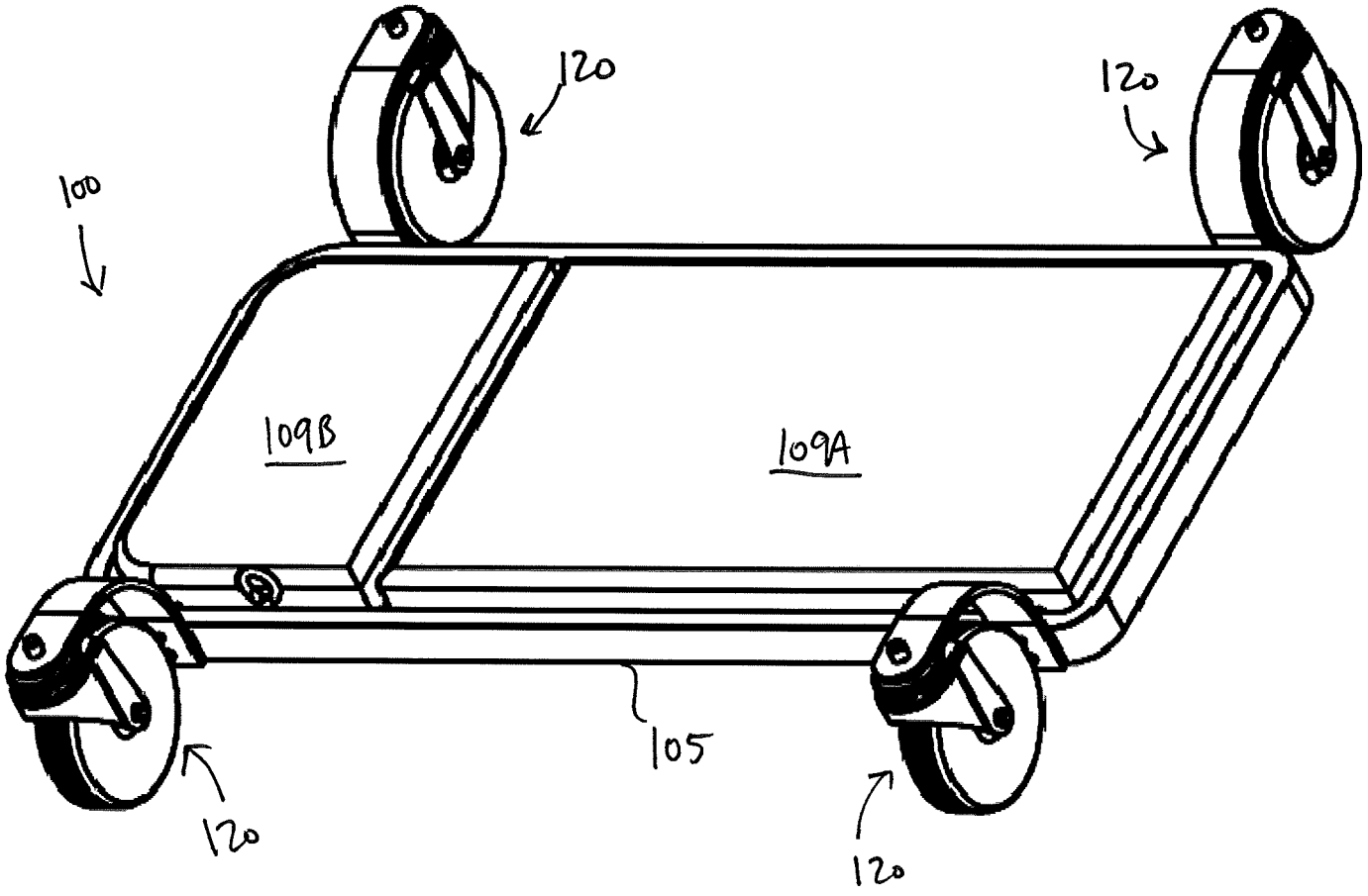
FIG. 2 is a perspective view of the creeper of FIG. 1.

Embodiments of creepers are described herein. Beginning with FIGS. 1 and 2, a creeper 100 is generally formed of a frame 105 having a first end 107A and a second end 107B, and cushions 109A and 109B respectively disposed on the frame 105. Wheel assemblies 120, described in greater detail below, are rotatably attached to the frame 105 to allow the creeper 100 to freely move about a surface.

Figure 3:
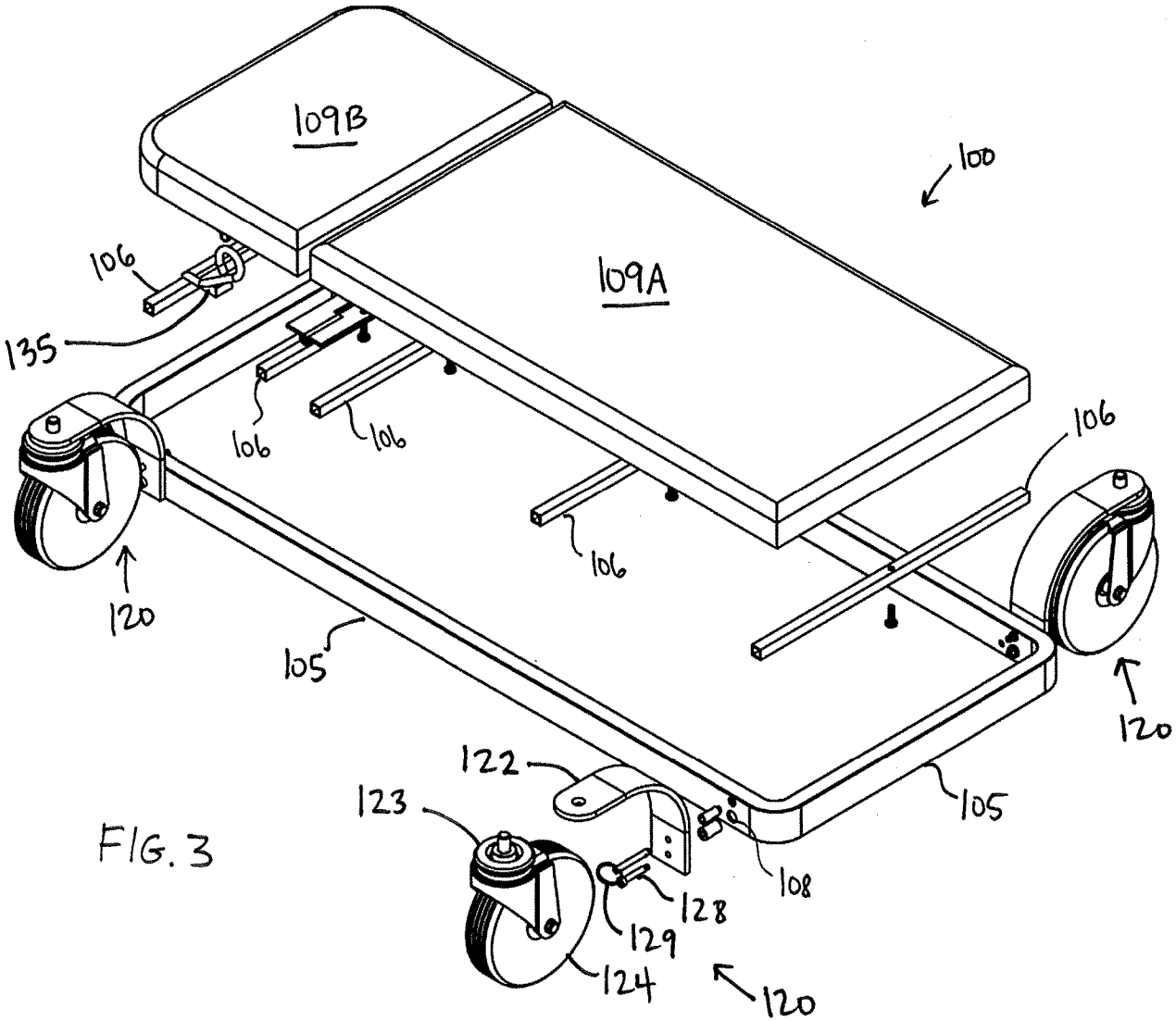
FIG. 3 is an exploded perspective view of the creeper of FIG. 1.

FIG. 3 shows an exploded view further illustrating the creeper 100. The frame 105 has a plurality of cross members 106 extending transversely across the frame 105. The cross members 106 provide support for the respective cushions 109A and 109B, as well as support for the frame 105 itself. As is described below, the head cushion 109B may be pivotally connected to the body cushion 109A or the frame 105 via a hinge 130, and a latch rod 135 allows the cushion 109B to rotate between a lowered, substantially horizontal position and an angled, raised position.

Figure 5:
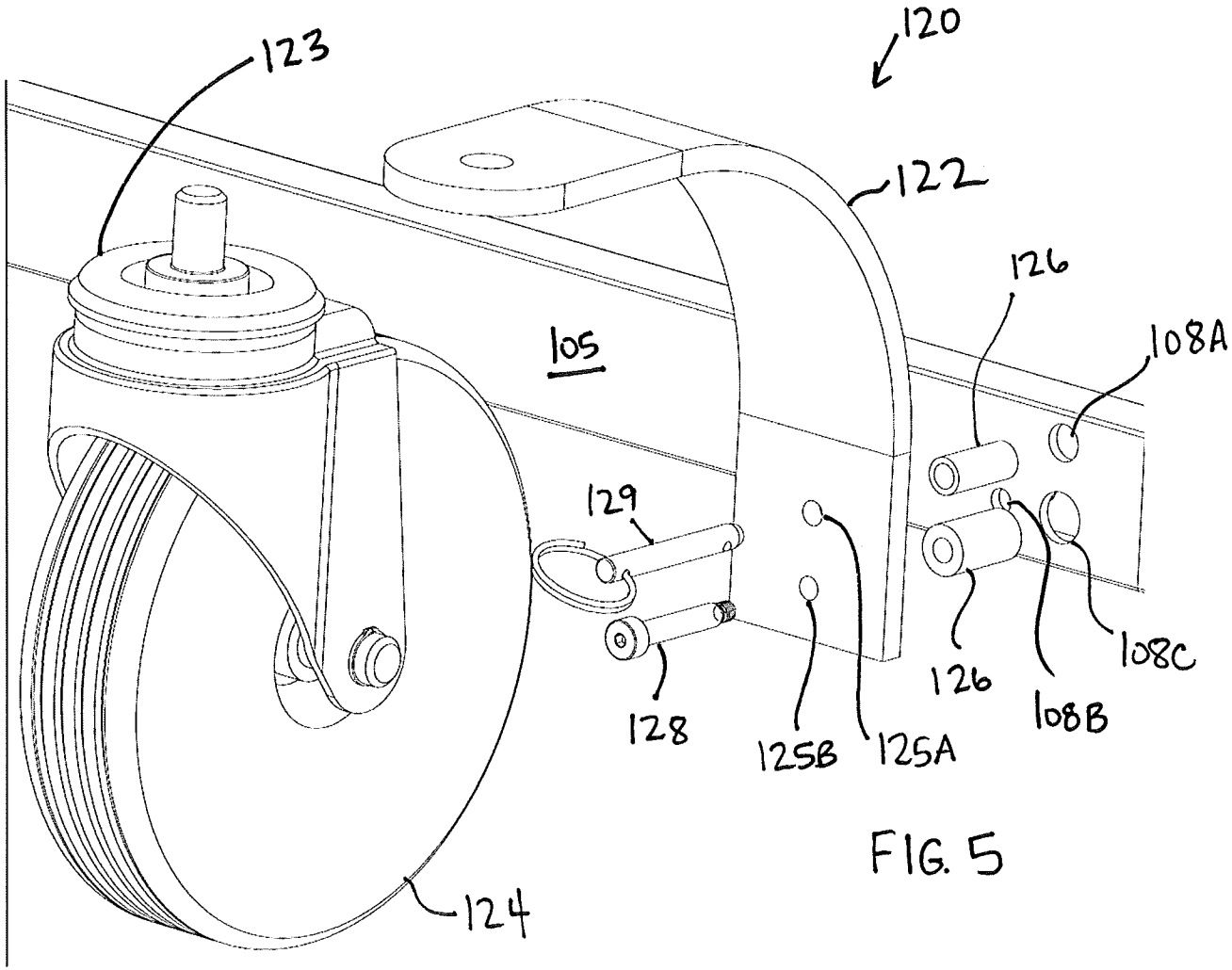
FIG. 5 is an exploded close-up view of a wheel assembly of the creeper of FIG. 1.

Shown in FIG. 3, and in an exploded close-up in FIG. 5, the wheel assembly 120 includes a bracket 122 and a wheel 124 with an attachment member 123 for engaging with the bracket 122. The bracket 122 includes first and second openings 125A and 125B which correspond to a respective first opening 108A and second and third openings 108B and 108C in the frame 105. Sleeves 126 engage with the openings 108A and 108B and are configured to receive fasteners to secure the bracket 122 to the frame 105. A first fastener 128 secures the bracket 122 to the frame 105. The fastener 128 may pass through the sleeve 126 in the opening 108A, and has a first end with threading to engage with a nut (not shown), and a second end without threading to allow the fastener 128 to rotate in the sleeve 126. A second fastener 129 may be, for example, a detent pin or other locking mechanism. The fastener 129 is inserted first through the opening 125B in the bracket 122, and then through the second or third opening 108B or 108C in the frame 105, depending on the desired configuration of the wheel 124.

Figure 6:
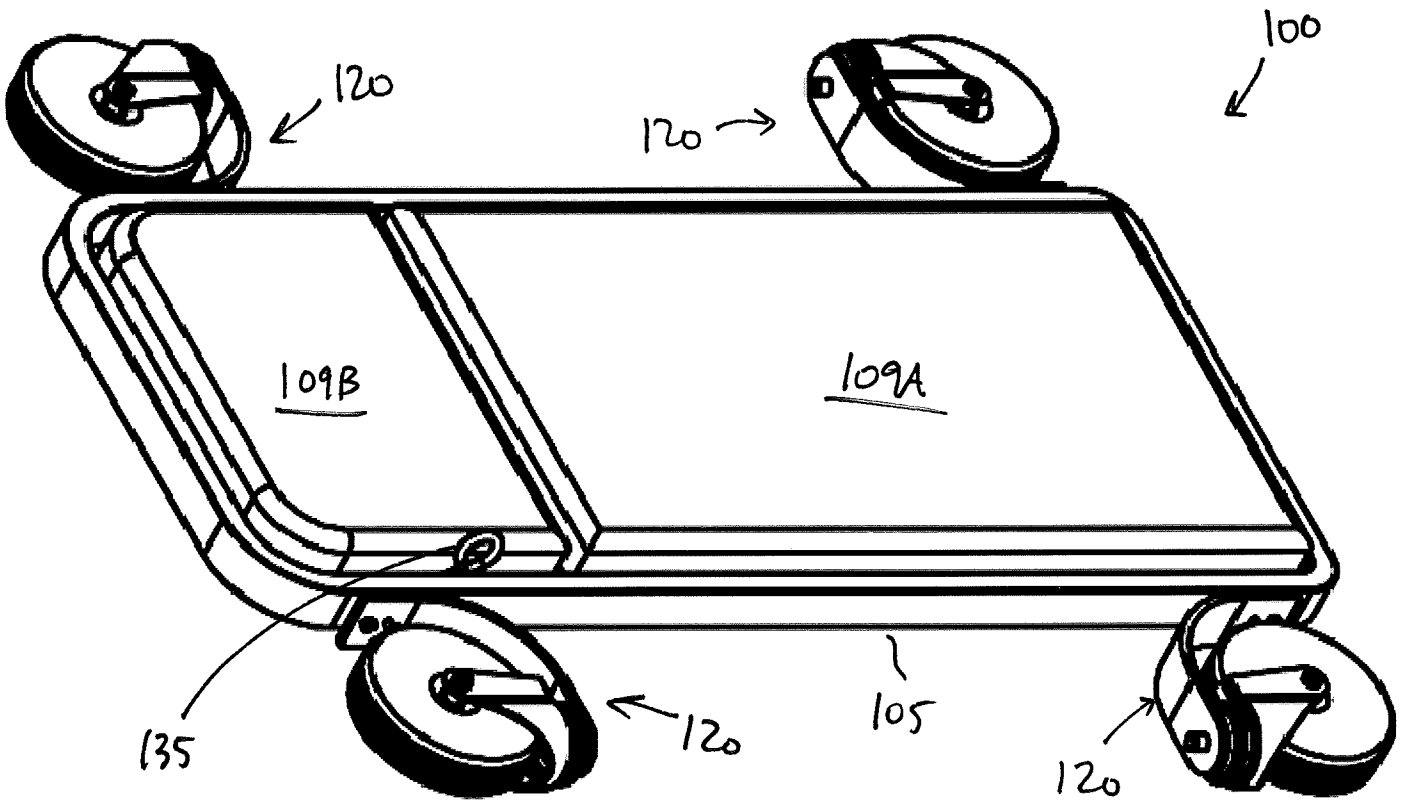
FIG. 6 is a perspective view of the creeper of FIG. 1 with the wheel assembly in a storage position.
Figure 7:
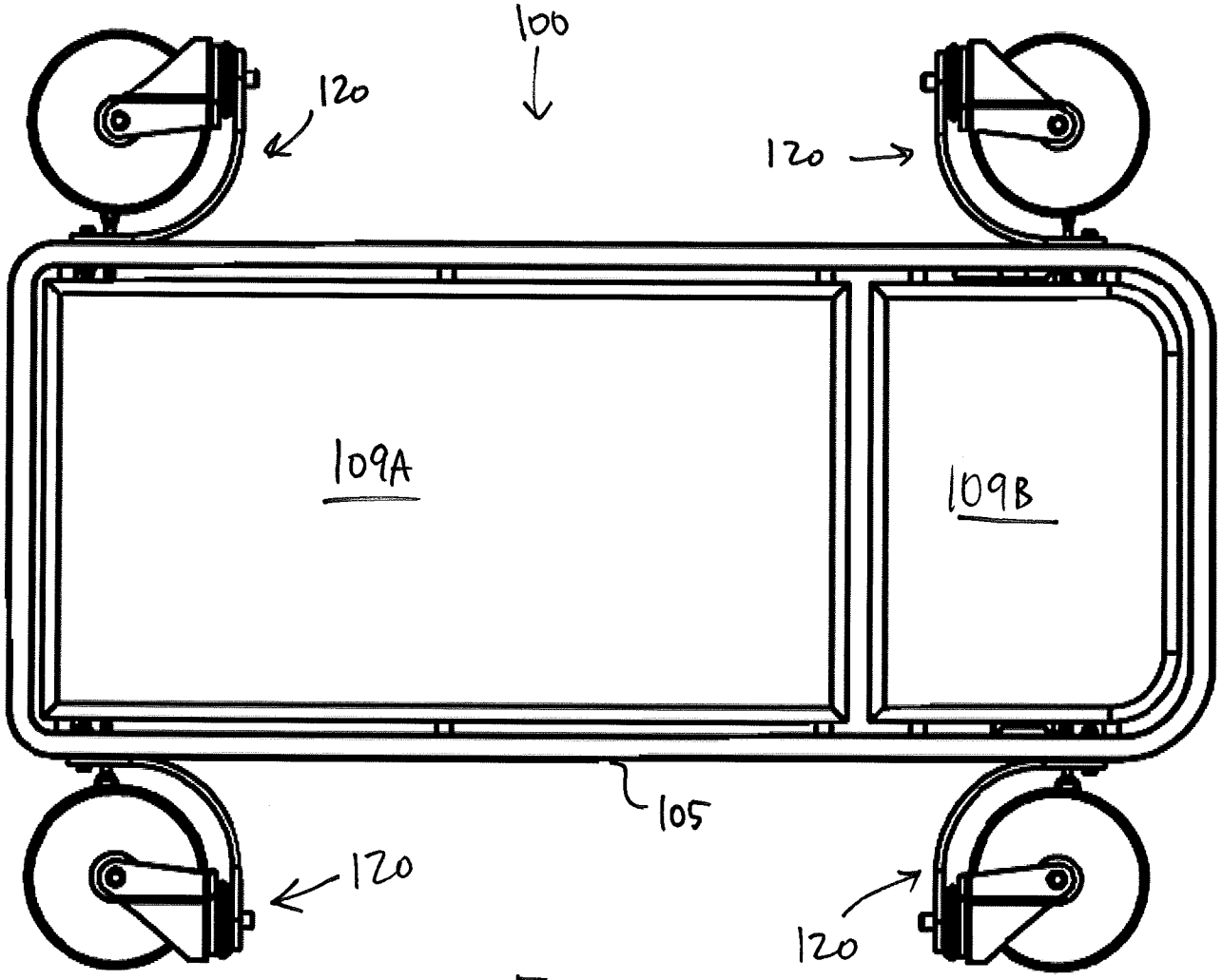
FIG. 7 is a top view of the creeper as shown in FIG. 6.

When the fastener 129 is inserted through the third opening 108B, as is illustrated in FIGS. 3 and 5, the wheel 124 is in an upright and engaged position, allowing the wheel 124 to function for the purpose of moving the creeper 100. However, when the fastener 129 is inserted through the second opening 108C, the wheel 124 is in a sideways and disengaged position. In the disengaged position, the creeper 100 is essentially flat, and can therefore be stored more easily. FIGS. 6 and 7 illustrate the creeper 100 with the wheel assembly 120 in a storage configuration, wherein the wheel 124 is in the disengaged position as described above.

This ability to rotate the wheels 124 to a storage position allows the wheels 124 to be larger than those previously used. Where the wheels 124 were previously limited in size based on concerns for the storage footprint, the wheels 124 can now be larger and therefore more conveniently sized for a non-level, non-hard terrain. Those of skill in the art shall also appreciate that the wheels 124 may be interchangeable such that the creeper 100 may be utilized on many different terrains.

Figure 4:
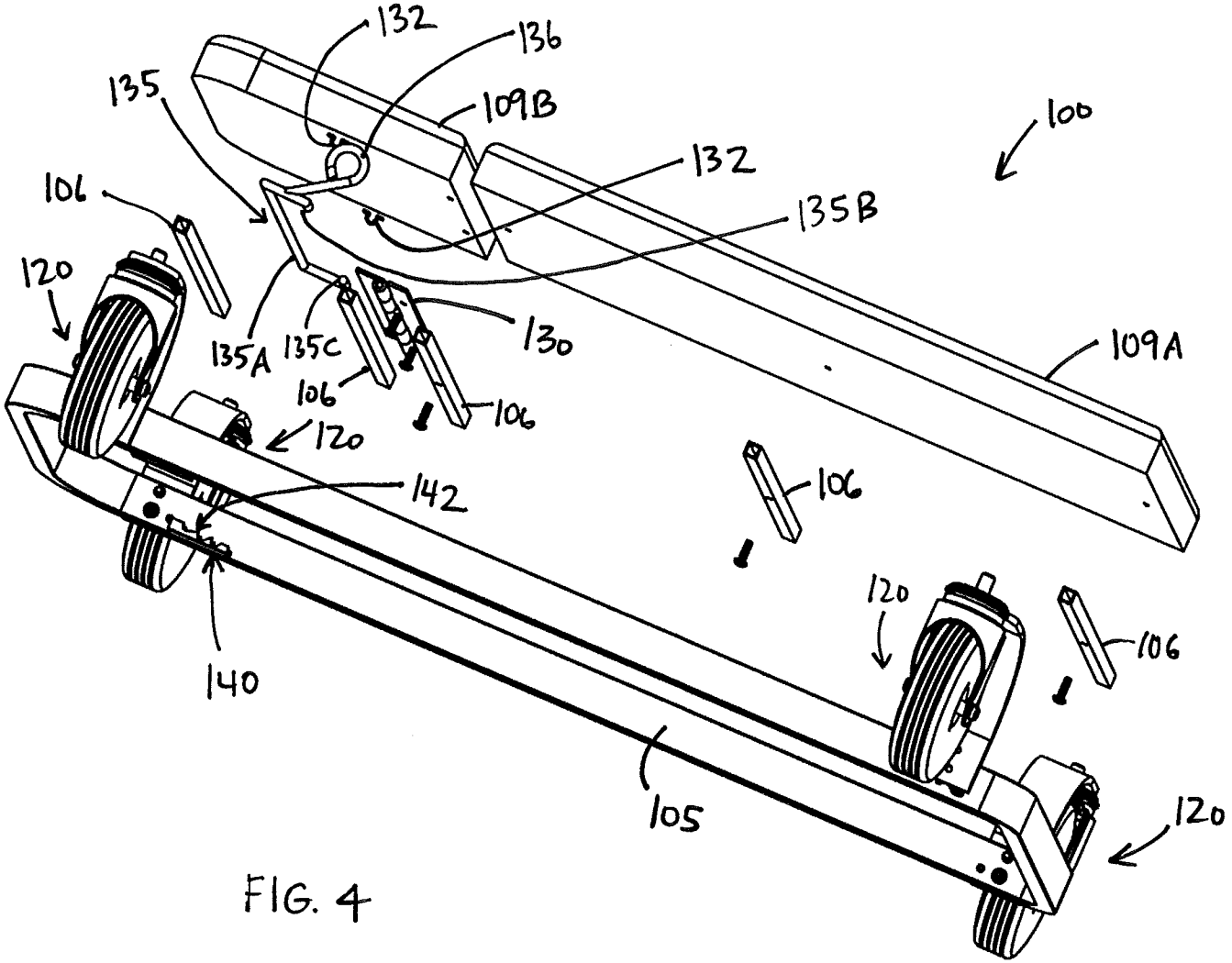
FIG. 4 is an exploded bottom perspective view of the creeper of FIG. 1.
Figure 8:
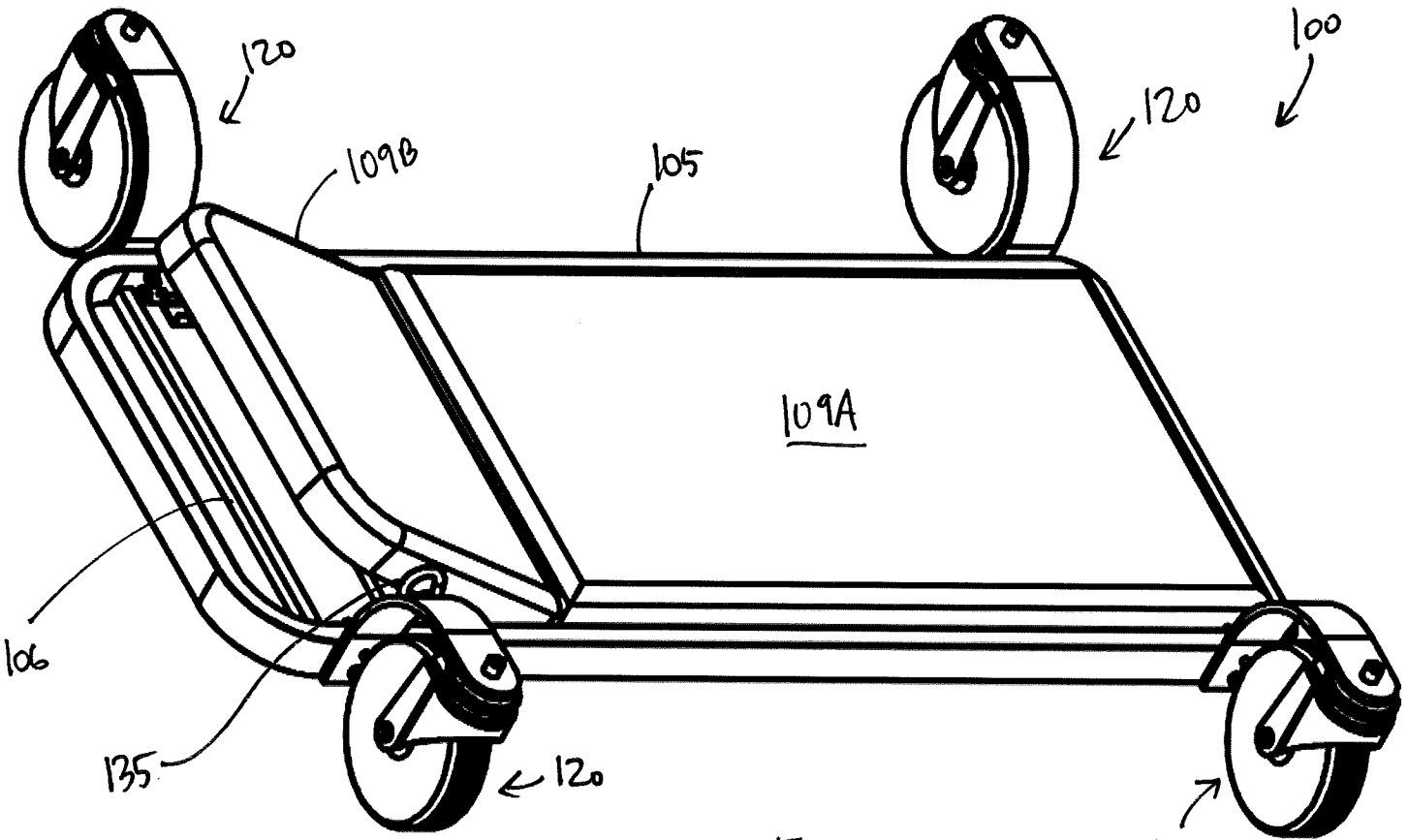
FIG. 8 is a perspective view of the creeper of FIG. 1 with the headrest in a raised position.
Figure 9:
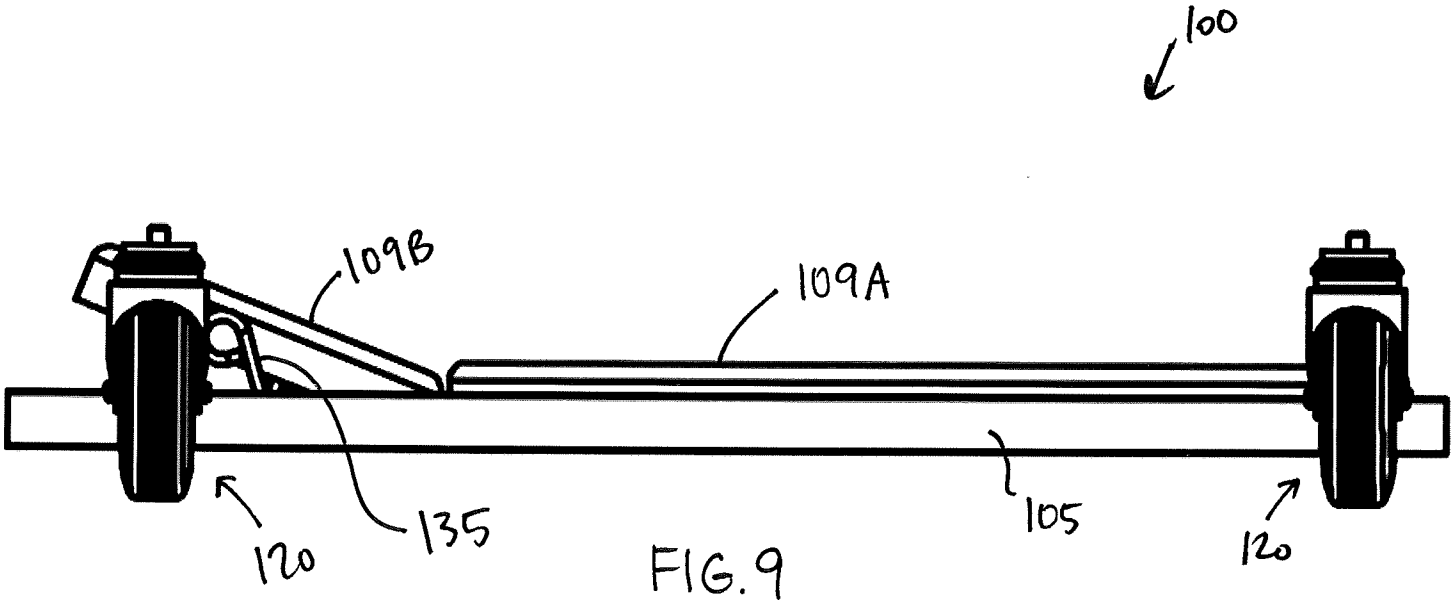
FIG. 9 is a side view of the creeper as shown in FIG. 8.
Figure 10:
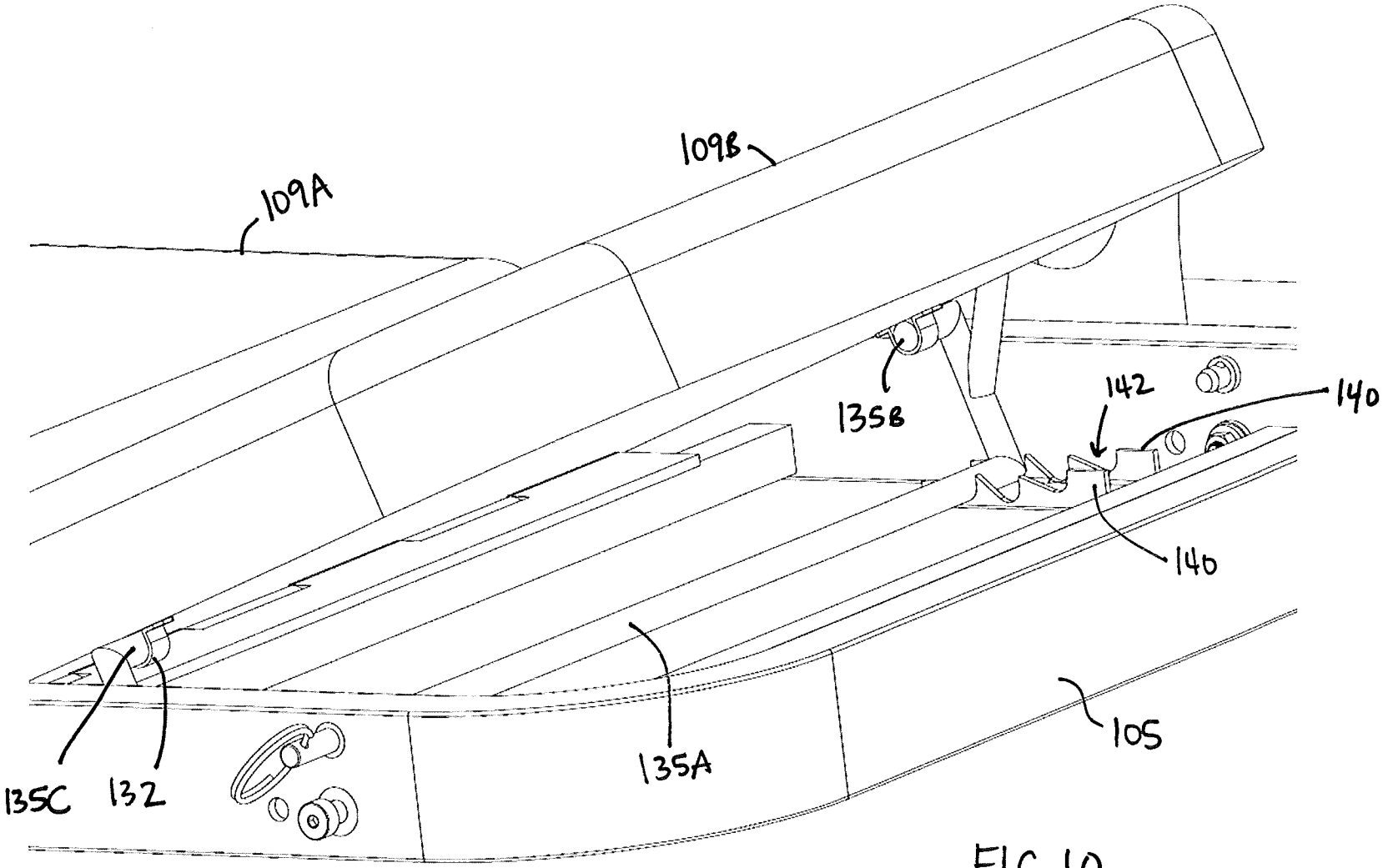
FIG. 10 is a close-up view of the headrest and headrest latch mechanism of the creeper of FIG. 8.

Referring again to FIG. 4 and to FIGS. 8-10, one side of a hinge 130 is fastened to the underside of the cushion 109B. The other side of the hinge 130 may be fastened to the frame 105 (e.g., via a cross member 106), or to the underside of cushion 109A. The hinge 130 allows the cushion 109B to rotate relative to the frame 105 (or the cushion 109A, as the case may be), which remains stationary and substantially flat. A latch rod 135 has a U-shaped portion 135A and respective ends 135B and 135C. The ends 135B and 135C extend inwardly from the U-shaped portion 135A, and engage with respective latch rod brackets 132 secured to the underside of the cushion 109B. The ends 135B and 135C are allowed to freely rotate within the latch rod brackets 132. A handle 136 extends upwardly from one side of the U-shaped portion 135A such that it is accessible by a user.

Locking members 140 are attached to either side the frame 105. A single locking member 140 may be attached to each side of the frame 105. Alternately, and as shown in FIG. 10, a pair of locking members 140 may be attached to each side of the frame 105. The locking members 140 forming each pair may be held together via a connection plate. The locking members 140 have a plurality of teeth 142 formed along a length thereof.

The U-shaped portion 135A of the latch rod 135 engaged with the teeth 142 in the respective locking members 140 to hold the headrest cushion 109B at a desired angle. To move the headrest cushion 109B to the desired position, a user pulls up on the handle 136 and rotates the cushion 109B upwards. The user then rotates the latch rod 135 such that the U-shaped portion 135A engages with the teeth 142 of the locking member 140 at the desired location. The headrest 109B can thus rotate between a lowered position (shown in FIGS. 1-3) and an angled position (shown in FIGS. 8-10). As multiple teeth 142 may be formed along the length of the locking members 140, the headrest 109B may be situated in one of several angled positions according to the preferences of a user.

Figure 11:
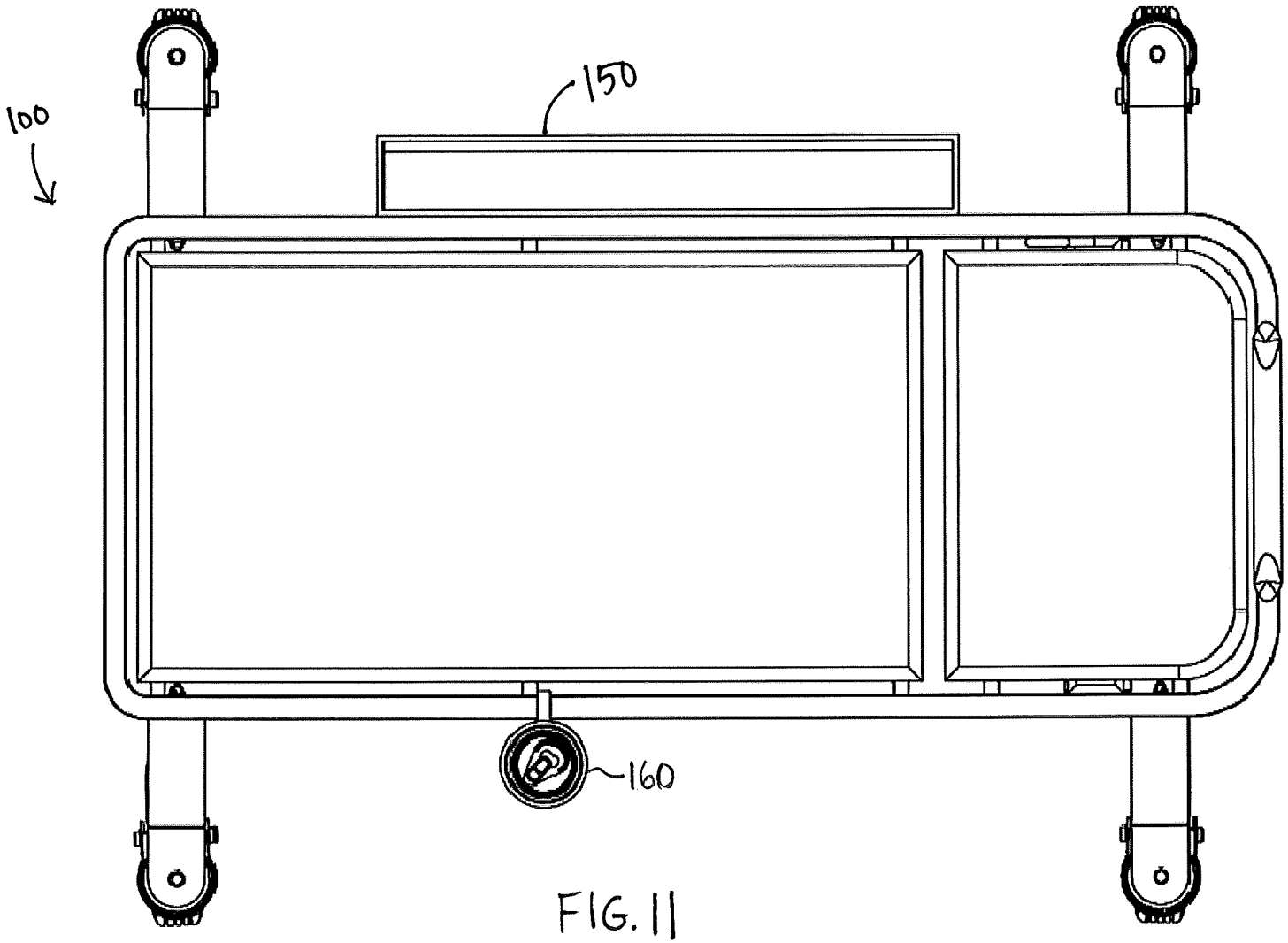
FIG. 11 is a top view of a creeper according to another embodiment of the invention.
Figure 12:
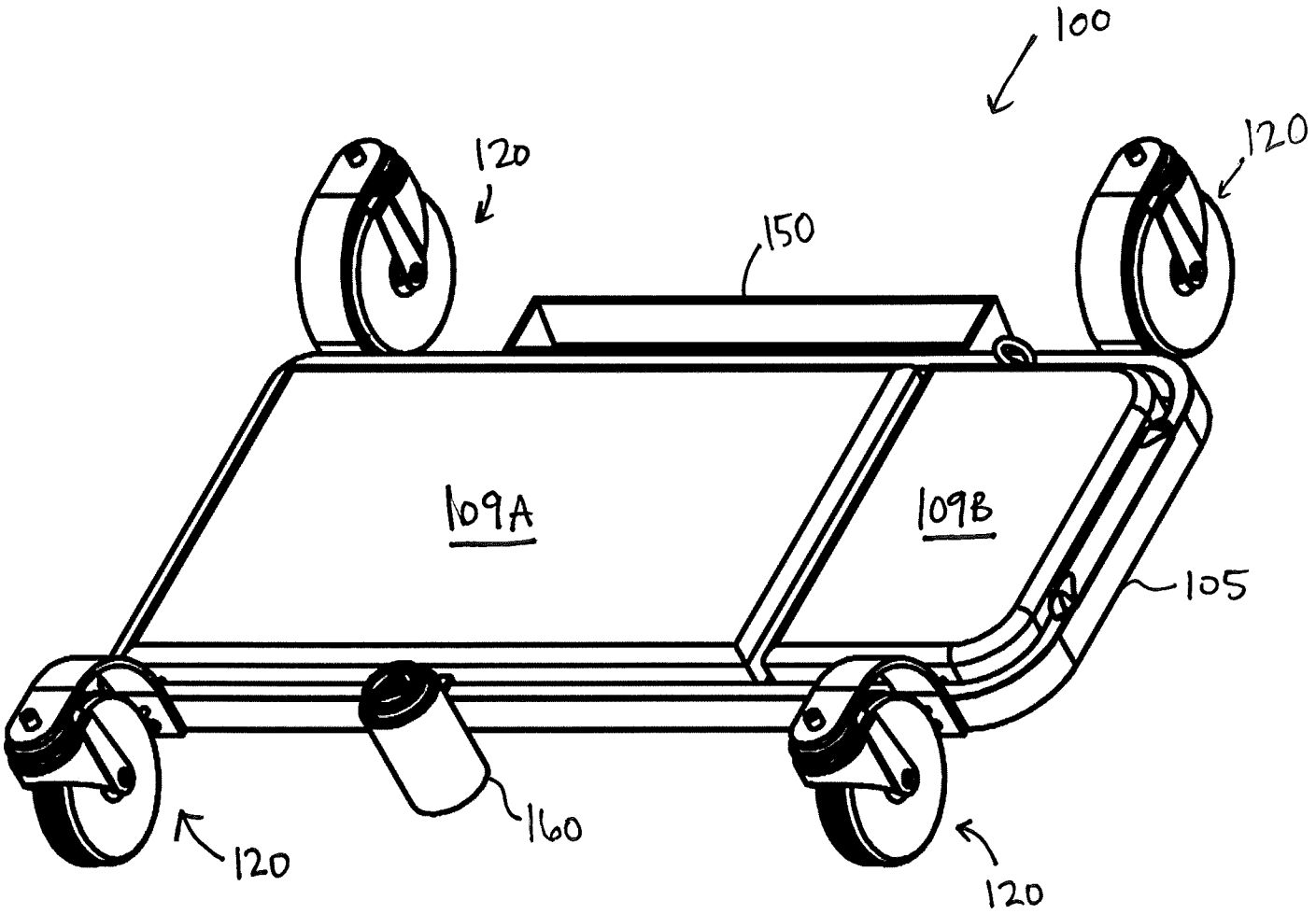
FIG. 12 is a perspective view of the creeper of FIG. 11.

Optional attachments may be provided separate from, or as part of, the frame 105. FIGS. 11 and 12 illustrate two exemplary attachments. In one embodiment, an attachment includes a tool tray 150. The tray 150 may be permanently attached to the frame 105 (e.g., via a weld, adhesive, etc.). Alternately, the tray 150 may be temporarily attached to the frame 105 (e.g., via brackets, magnets, etc.). In another embodiment, a beverage container 160 is attached to the frame 105. It shall be understood that the tool tray 150 and the beverage container 160 can both be attached to the frame 105 at the same time. Other attachments may additionally, or alternately, be attached to the frame 105. For example, speakers, light strips, or other auxiliary attachments may provide even further functionality over prior art creepers.

Any suitable materials may be used in the manufacture of the creeper 100, as is known to those of skill in the art.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

What is claimed is:

1. A creeper, comprising:

a frame having a first end and a second end spatially separated by first and second parallel members to form a generally rectangular configuration;

a body cushion mounted at the first end of the frame;

a head cushion mounted at the second end of the frame, the head cushion being hingedly connected to the frame;

a plurality of wheel assemblies rotatably mounted to the frame, each wheel assembly comprising:

a wheel with an attachment member;

a bracket comprising a first planar portion and a second planar portion, the second planar portion extending perpendicularly from the first planar portion at a rounded corner and a first and second opening formed in the first planar portion; and first and second fasteners;

wherein:

the first opening in the bracket corresponds to a first opening in a side surface of the frame;

the first fastener is inserted through the respective first openings in the bracket and the frame to secure the bracket to the frame;

the second opening in the bracket corresponds to one of a second opening and a third opening in the frame;

the second fastener is inserted through the second opening of the bracket and one of the second or third openings in the frame;

when the second fastener is inserted through the second opening in the frame, the wheel assembly is in an operating position;

when the second fastener is inserted through the third opening in the frame, the wheel assembly is in a storage position; and in the operating position, the second planar portion extends above a horizontal plane formed by a top edge of the frame.

2. The creeper of claim 1, further comprising a plurality of cross-members extending transverse across the frame.

3. The creeper of claim 1, further comprising a locking assembly for moving the head cushion between a substantially horizontal position and an angled position, the locking assembly comprising:

a latch rod having a U-shaped portion and respective first and second ends extending inwardly from the U-shaped portion;

first and second latch rod brackets secured to a bottom side of the head cushion, the first and second ends of the latch rod being rotatably received into the respective first and second latch rod brackets; and a locking mechanism secured to an inner face of each of the parallel members, the U-shaped portion of the latch rod being received into the respective locking mechanisms to secure the head cushion in an angled position.

4. The creeper of claim 3, wherein the latch rod further comprises a handle extending from the U-shaped portion.

5. The creeper of claim 4, wherein the locking mechanism comprises a plurality of teeth, and wherein the U-shaped portion of the latch rod engages with the teeth to secure the head cushion in an angled position.

6. The creeper of claim 5, wherein, in operation, a user pulls the handle up to raise the head cushion from a first position and disengage the latch rod from the teeth of the respective locking mechanisms, and subsequently reengages the latch rod with the teeth of the respective locking mechanism in a second position.

7. The creeper of claim 5, wherein each locking mechanism comprises two corresponding locking member plates spatially separated by a connection plate, the teeth being formed into the locking member plates.

8. The creeper of claim 1, further comprising sleeves disposed within the respective first, second, and third openings in the frame for receiving the respective first and second fasteners.

9. The creeper of claim 8, wherein the second fastener is a detent pin.

10. The creeper of claim 1, further comprising at least one accessory selected from the list consisting of: a tool tray, a beverage container, speakers, and a light.

11. A creeper, comprising:

a frame having a first end and a second end to form a generally rectangular configuration;

a body cushion mounted at the first end of the frame;

a head cushion mounted at the second end of the frame, the head cushion being hingedly connected to the frame, and comprising a locking assembly attached to an underside thereof, the locking assembly comprising:

a latch rod having a middle portion and first and second end portions;

first and second latch rod brackets secured to a bottom side of the head cushion, the first and second end portions being rotatably received into the respective first and second latch rod brackets; and a locking mechanism secured to an inner face of each of the parallel members, the middle portion of the latch rod being received into the respective locking mechanisms to secure the head cushion in an angled position; and a plurality of wheel assemblies rotatably mounted to the frame, each wheel assembly comprising:

a wheel with an attachment member;

a bracket having a first opening and a second opening; and first and second fasteners;

wherein:

the first opening in the bracket corresponds to a first opening in the frame;

the first fastener is inserted through the respective first openings in the bracket and the frame to secure the bracket to the frame;

the second opening in the bracket corresponds to one of a second opening and a third opening in the frame;

the second fastener is inserted through the second opening of the bracket and one of the second or third openings in the frame;

when the second fastener is inserted through the second opening in the frame, the wheel assembly is in an operating position; and when the second fastener is inserted through the third opening in the frame, the wheel assembly is in a storage position.

12. The creeper of claim 11, wherein the latch rod further comprises a handle extending upwardly therefrom.

13. The creeper of claim 12, wherein the locking mechanism comprises a plurality of teeth, and wherein the middle portion of the latch rod engages with the teeth to secure the head cushion in an angled position.

14. The creeper of claim 13, wherein each locking mechanism comprises two corresponding locking member plates, the teeth being formed into the locking member plates.

15. The creeper of claim 11, further comprising at least one accessory selected from the list consisting of: a tool tray, a beverage container, speakers, and a light.

16. A creeper, comprising:

a frame having a first end and a second end;

a body cushion mounted at the first end of the frame;

a head cushion mounted at the second end of the frame, the head cushion being hingedly connected to the frame, and comprising a locking assembly attached to an underside thereof, the locking assembly comprising:

a latch rod;

at least one latch rod bracket secured to a bottom side of the head cushion, a portion of the latch rod being rotatably received into the latch rod bracket; and a locking mechanism secured to an inner face of the frame, a portion of the latch rod being selectively received into the locking mechanism to secure the head cushion in an angled position; and a plurality of wheel assemblies rotatably mounted to the frame, each wheel assembly being configured to rotate between an operation position and a storage position, wherein, in the storage position, a bracket of the wheel assembly is horizontal relative to a ground surface, and in the operation position, the bracket extends above the frame.

17. The creeper of claim 16, wherein the latch rod comprises a U-shaped portion and respective end portions extending from the U-shaped portion, wherein the U-shaped portion engages with the locking mechanism and the respective end portions engage with respective latch rod brackets.

18. The creeper of claim 17, wherein the locking mechanism comprises a plurality of teeth, and wherein the U-shaped portion of the latch rod engages with the teeth to secure the head cushion in an angled position.

19. The creeper of claim 18, wherein the locking mechanism comprises two corresponding locking member plates, the teeth being formed into the locking member plates.

20. The creeper of claim 16, further comprising at least one accessory selected from the list consisting of: a tool tray, a beverage container, speakers, and a light.

21. A creeper, comprising:

a frame having a first end and a second end, a body cushion mounted at the first end of the frame, and a head cushion mounted at the second end of the frame, a top edge of the frame defining a generally horizontal plane; and a plurality of wheel assemblies rotatably mounted to the frame, each wheel assembly comprising:

a wheel with an attachment member;

a bracket comprising a first planar portion and a second planar portion, the second planar portion extending perpendicularly from the first planar portion at a rounded corner and a first and second opening formed in the first planar portion; and first and second fasteners;

wherein:

the first opening in the bracket corresponds to a first opening in a side surface of the frame;

the first fastener is inserted through the respective first openings in the bracket and the frame to secure the bracket to the frame;

the second opening in the bracket corresponds to one of a second opening and a third opening in the frame;

the second fastener is inserted through the second opening of the bracket and one of the second or third openings in the frame;

when the second fastener is inserted through the second opening in the frame, the wheel assembly is in an operating position;

when the second fastener is inserted through the third opening in the frame, the wheel assembly is in a storage position; and in the operating position, the second planar portion extends above the horizontal plane.

* * * * *